US008887513B2

(12) United States Patent
Kotzot et al.

(10) Patent No.: US 8,887,513 B2
(45) Date of Patent: Nov. 18, 2014

(54) THREE-SHELL CRYOGENIC FLUID HEATER

(75) Inventors: Heinz J. Kotzot, The Woodlands, TX (US); Felix J. Fernandez de la Vega, Houston, TX (US); Joseph H. Cho, Katy, TX (US); Charles Durr, Houston, TX (US); Robert Burlingame, Houston, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 1469 days.

(21) Appl. No.: 11/933,886

(22) Filed: Nov. 1, 2007

(65) Prior Publication Data

US 2008/0115508 A1 May 22, 2008

Related U.S. Application Data

(60) Provisional application No. 60/856,663, filed on Nov. 3, 2006.

(51) Int. Cl.

| | |
|---|---|
| ***F17C 9/02*** | (2006.01) |
| ***F17C 9/04*** | (2006.01) |
| ***F17C 7/04*** | (2006.01) |
| *F28D 7/16* | (2006.01) |

(52) U.S. Cl.

CPC ... *F17C 7/04* (2013.01); *F17C 9/04* (2013.01); *F17C 9/02* (2013.01); *F17C 2223/0153* (2013.01); *F17C 2225/0123* (2013.01); *F17C 2227/0302* (2013.01); *F17C 2265/05* (2013.01); *F28D 7/16* (2013.01); *F17C 2221/033* (2013.01); *F17C 2221/035* (2013.01); *F17C 2223/0161* (2013.01); *F17C 2223/033* (2013.01); *F17C 2227/0309* (2013.01); *F17C 2227/0313* (2013.01); *F17C 2227/0327* (2013.01); *F17C 2227/0397* (2013.01)

USPC ..... 62/50.2

(58) Field of Classification Search

CPC ..... F17C 7/04; F17C 9/02; F17C 9/04; F17C 2227/0309; F17C 2227/0306; F17C 2227/0302; F17C 2227/0393; F28D 15/00; F28D 7/16

USPC ..... 62/50.2, 53.2

See application file for complete search history.

(56) References Cited

U.S. PATENT DOCUMENTS 3,446,029 A * 5/1969 Grgurich et al. ..... 62/50.2
3,570,828 A 3/1971 Cowan (Continued)

OTHER PUBLICATIONS

Cho J.H., Kotzot H., Patel H., and Durr C. "Low Emissions with Advanced Vaporization Processes", AIChE LNG Conference, Vancouver, Sep. 2005.*

(Continued)

*Primary Examiner* — Frantz Jules
*Assistant Examiner* — Keith Raymond
(74) *Attorney, Agent, or Firm* — Gary M. Machetta

(57) ABSTRACT

Systems and methods for heating a cryogenic fluid are provided. A cryogenic fluid can be heated to provide a partially cryogenic vaporized fluid having a first temperature. The partially vaporized cryogenic fluid can be partially vaporized to provide a second partially vaporized fluid having a second temperature. At least a portion of the second, partially vaporized, cryogenic fluid can be used to heat the cryogenic fluid to the first temperature. The second, partially vaporized, cryogenic fluid can be partially vaporized to provide a substantially vaporized cryogenic fluid having a third temperature.

20 Claims, 2 Drawing Sheets

(56) References Cited

U.S. PATENT DOCUMENTS

| | | | | |
|---|---|---|---|---|
| 3,770,048 | A | 11/1973 | Linhardt et al. | |
| 3,827,247 | A * | 8/1974 | Kojima et al. | 62/50.2 |
| 4,170,115 | A * | 10/1979 | Ooka et al. | 62/50.2 |
| 4,519,213 | A | 5/1985 | Brigham et al. | |
| 5,251,452 | A | 10/1993 | Wieder | |
| 6,564,579 | B1 * | 5/2003 | McCartney | 62/620 |
| 6,598,408 | B1 | 7/2003 | Nierenberg | |
| 6,622,492 | B1 | 9/2003 | Eyermann | |
| 6,622,496 | B2 * | 9/2003 | Cheng et al. | 62/86 |
| 6,644,041 | B1 | 11/2003 | Eyermann | |
| 6,889,523 | B2 * | 5/2005 | Wilkinson et al. | 62/613 |
| 7,155,917 | B2 | 1/2007 | Baudat | |
| 7,168,395 | B2 | 1/2007 | Engdahl | |
| 2003/0158458 | A1 * | 8/2003 | Prim | 585/800 |
| 2005/0274126 | A1 * | 12/2005 | Baudat | 62/50.2 |
| 2008/0190106 | A1 * | 8/2008 | Mak | 60/531 |

OTHER PUBLICATIONS

Cho, Joseph H. et al. "Cost Effective Air Heater Vaporization with the Three-Shell Vaporizer," LNG Journal, Nov. 2006, pp. 1-16, Kellogg Brown & Root, Inc., Houston, Texas, USA.

Cho, Joseph H. et al., "LNG vaporization needs low-cost and environmentally-friendly solutions," LNG Journal, Mar. 2006, pp. 28-30, KBR, Houston, Texas, USA.

Cho, Joseph H. et al., "Three-shell vaporizer proves to be cost effective air heater vaporization system," LNG Journal, Nov./Dec. 2006, pp. 43-51, KBR.

Yang, C.C. et al., "LNG Regasification terminals: established and emerging vaporizer options," Gas Technology Institute Conference on Natural Gas Technologies, Jan. 31, 2005-Feb. 2, 2005, Orlando, Florida, USA.

"LNG Smart Vaporization—Process Demonstration," Mustang, Dec. 8, 2004, pp. 1-17, Houston, Texas, USA.

* cited by examiner

THREE-SHELL CRYOGENIC FLUID HEATER

CROSS-REFERENCE TO RELATED APPLICATIONS

This application claims benefit of U.S. Provisional Application having Ser. No. 60/856,663, filed on Nov. 3, 2006, the entirety of which is incorporated by reference herein.

BACKGROUND

1. Field

The present embodiments generally relate to systems and methods for heating cryogenic fluids. More particularly, embodiments relate to systems and methods for heating liquefied natural gas ("LNG") using an environmentally friendly three shell heater design.

2. Description of the Related Art

Since liquefied natural gas ("LNG") occupies approximately 600 times less volume than an equivalent weight of gasified natural gas, the liquefied form of natural gas is the preferred method for economical, large scale, intercontinental, shipment of LNG. Most modern LNG tankers range in size from 50,000 $m^3$ to in excess of 200,000 $m^3$. A 120,000 $m^3$ LNG tanker is capable of transporting the equivalent of approximately 74 million standard cubic meters (2.6 billion standard cubic feet) of natural gas, or the per capita usage of approximately 35,000 people. However, the handling of such large volumes of gas requires significant fixed assets be dedicated to both the liquification of the natural gas at the port of departure and regasification of the LNG at the port of arrival.

Upon arrival at a destination port, the LNG is vaporized prior to introduction to one or more natural gas distribution networks. With a heat of vaporization of approximately 550 kJ/kg, and a bulk density of approximately 445 kg/$m^3$, the vaporization of relatively small quantities of LNG requires significant heat. For example, complete vaporization of 120,000 $m^3$ of LNG will require approximately $2.9\times10^{10}$ kJ ($2.7\times10^{10}$ BTU). In many circumstances, hot water or steam is used to provide the heat required to vaporize the LNG. Unfortunately, systems based upon the use of water or steam as a heating media are prone to freezing due to the low boiling point of the natural gas (−162° C.). Freezing impairs the efficiency of the vaporization process, requiring more heat transfer surface area than if the icing could be avoided.

The evaporators presently used are mainly of the open rack type, intermediate fluid type and submerged combustion type. Open rack type evaporators use sea water as a heat source for vaporizing the LNG. These evaporators use once-through seawater flow on the outside of a heat exchanger as the source of heat. Untreated sea water, however, often contains substantial quantities of suspended solids which can foul the evaporator, thereby reducing the heat transfer efficiency and increasing the time required to vaporize the LNG. In addition to the potential fouling of the evaporator, regasification using sea water can cause thermal pollution in the surrounding estuarine waters. Thus, the use of open rack type vaporizers is often not the system of choice because of environmental reasons. Regasification using estuarine waters as a heating medium is discussed in U.S. Pat. Nos. 6,089,022, 6,164,247, and 6,598,408.

Intermediate fluid type evaporators use propane, halogenated hydrocarbons or similar refrigerants having a low freezing point to supply heat to LNG instead of using direct heating with water or steam. The refrigerant is usually heated with hot water or steam to provide both the sensible heat and heat of vaporization of the refrigerant for heating the LNG. Intermediate fluid type evaporators are typically less expensive to build than those of the open rack-type but intermediate fluid type evaporators consume a portion of the LNG as fuel to heat the refrigerant. A typical intermediate fluid type evaporator can consume between 1.5% and 3% of the total LNG vaporized as fuel.

Submerged combustion type evaporators, i.e. submerged combustion vaporizers ("SCV") typically contain a heated combustion chamber containing an LNG fired burner immersed in a liquid bath. SCVs can provide an efficient alternative to other types of fired heaters; however, SCVs also consume a portion of the vaporized LNG product to provide the heat for vaporization. While avoiding potential freezing issues encountered when using water as a heating medium, local, state and federal air permits may be required to operate an SCV, additionally $NO_x$ emissions from an SCV may require selective catalytic reaction (SCR) to achieve permit compliance. U.S. Pat. No. 7,168,395 discusses the use of a submerged combustion LNG vaporizer using a gas fired submerged heater.

There is a need, therefore, for an improved system and method for vaporizing LNG and other cryogenic fluids without the risk of freeze-up, with minimal environmental impact and with minimal permitting requirements.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

Figure 1:
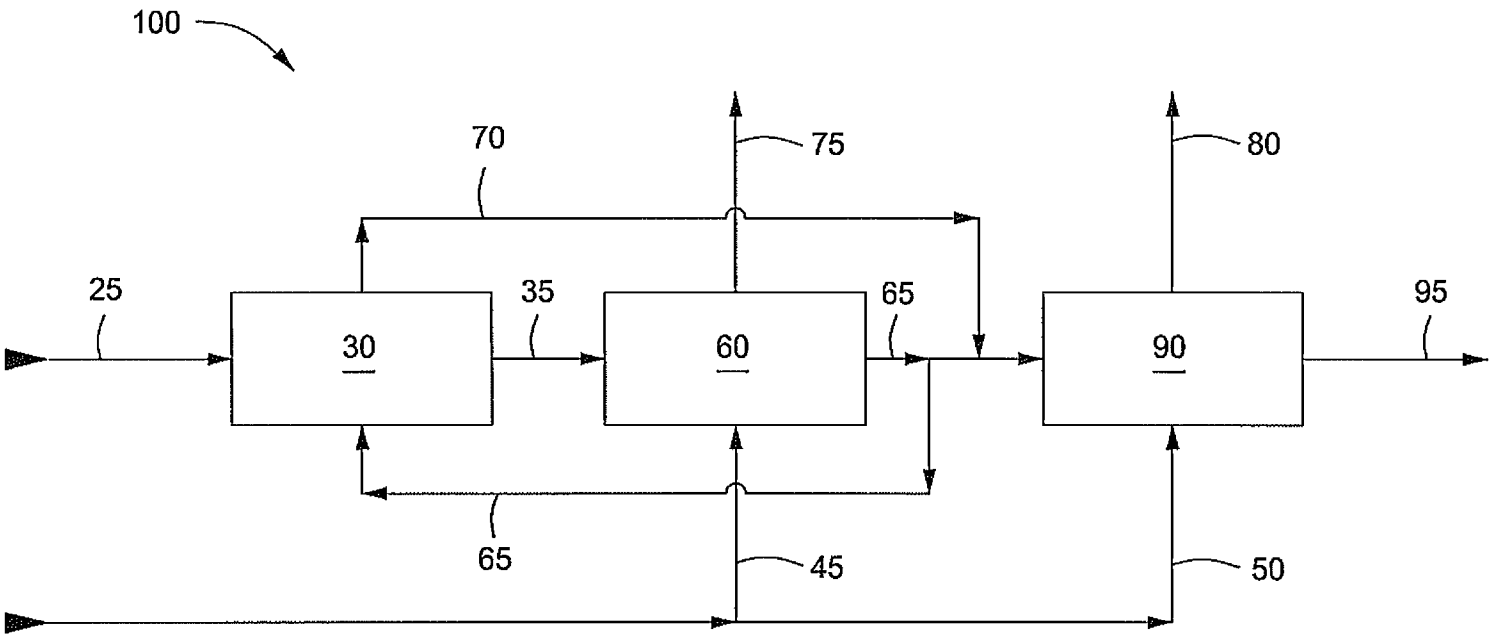
FIG. 1 depicts an illustrative system for vaporizing a cryogenic fluid, according to one or more embodiments described.

FIG. 1 depicts an illustrative system 100 for vaporizing a cryogenic fluid according to one or more embodiments. The system 100 can include three or more heat transfer exchangers or heat transfer zones (three are shown 30, 60, 90). Each heat transfer zone 30, 60 and 90 can be disposed within a single shell or self-contained and arranged in series so that a cryogenic fluid to be at least partially vaporized can be progressively heated within the system 100. In one or more embodiments, the first heat exchanger or zone 30 can be an interchanger, the second heat exchanger or zone 60 can be a heater, and the third heat exchanger or zone 90 can be a superheater.

In one or more embodiments, a cryogenic fluid, via line 25, can be heated within the first heat transfer zone 30 to provide a partially vaporized fluid. The partially vaporized fluid can exit the first heat transfer zone 30 via line 35 and enter the second heat transfer zone 60 where the fluid temperature is further increased to provide a second partially vaporized fluid. The second partially vaporized fluid can exit the second heat transfer zone 60 and return to the first heat transfer zone 30 via line 65 where it can be cooled against the incoming feed (via line 25). The cooled fluid can exit the first heat transfer zone 30 via line 70, and enter the third heat transfer zone 90 where it can be heated to a third temperature, providing a totally vaporized fluid via line 95. The recycled fluid via line 65 can be referred to herein as the "first heat transfer fluid medium" or "first HTF").

In one or more embodiments, the heat supplied to the second heat transfer zone 60 can be provided by one or more heat transfer mediums supplied via line 45 and returned via line 75. In one or more embodiments, the heat to the third heat transfer zone 90 can also be provided by one or more heat transfer mediums supplied via line 50 and returned via line 80. The heat transfer mediums to the second and third heat transfer zones 60, 90 can be the same or different. The heat transfer medium(s) can be steam and/or superheated steam, glycol, or other available fluid that has been heated above the sendout gas temperature. In one or more embodiments, the heat transfer mediums can include, but are not limited to methane, ethane, propane, butane, pentane, halogenated hydrocarbons, ammonia, glycol-water mixtures, formate-water mixtures, alcohols (including, but not limited to, methanol, ethanol and/or propanol), mixtures thereof, derivatives thereof and/or combinations thereof.

The heat transfer area within each heat transfer zone 30, 60, 90 can be dependent on multiple factors including, but not limited to, cryogenic fluid feed rate, available heat transfer medium temperature and volume, and/or physical space limitations. The heat transfer zones 30, 60 and 90 can be any non-contact system, equipment, device or collection of one or more non-contact systems, equipment or devices to provide heat to the incoming cryogenic fluid using a recycled warm cryogenic fluid. Each heat transfer zones 30, 60, 90 can be fabricated from materials suitable for use in cryogenic service, including but not limited to, copper and copper alloys, aluminum and aluminum alloys, nickel-chromium type stainless steels, carbon-manganese-silicon steels, or chromium-nickel austenitic stainless steels. Each heat transfer zone 30, 60, 90 can include, but is not limited to, shell-and-tube heat exchangers, U-tube heat exchangers, plate and frame heat exchangers, wiped film evaporators or any other equivalent devices for transferring heat from a heat transfer media to a liquid, partially vaporized or completely vaporized fluid. Enhanced tubing products containing fins, flutes or other surface preparations to improve heat transfer and/or to increase effective surface area of the tube can be used. For example, illustrative enhanced tubing products include, but are not limited to, tubing products such as Tru-fin® and Turbo® tubing lines offered by Wolverine Tube, Inc.

The cryogenic fluid to be heated and/or at least partially vaporized within the system 100 can be liquefied natural gas ("LNG"), liquefied petroleum gas ("LPG"), liquefied oxygen, liquefied nitrogen, liquefied hydrocarbons, mixtures thereof or combinations thereof. In one or more specific embodiments, the fluid can include cryogenically liquefied natural gas ("LNG") and/or a mixture consisting essentially of LNG, (i.e. a mixture containing a minimum of 51% LNG). For simplicity and ease of description, however, embodiments of the invention will be further described with reference to LNG.

In one or more embodiments, LNG can be supplied via line 25 to the first heat transfer zone 30 as a liquid or as a two phase (e.g. vapor-liquid) mixture. The LNG introduced to the first heat transfer zone 30 can enter at a temperature of from about −170° C. to about 0° C.; about −170° C. to about −50° C.; or about −170° C. to about −100° C. at a pressure of about 100 kPa to about 5,000 kPa; about 100 kPa to about 2,500 kPa; or about 100 kPa to about 1,000 kPa. In one or more embodiments, the LNG supplied to the first heat transfer zone 30 can be all liquid phase or about 25% vapor, about 20% vapor, about 15% vapor, about 10% vapor, about 5% vapor, about 1% vapor or about 0.5% vapor, the balance liquid phase.

The LNG can be heated within the first heat transfer zone 30 to a second temperature. The temperature rise can be sufficient to at least partially vaporize the LNG or sufficient to produce more vapor within the LNG vapor-liquid mixture entering in line 25. In one or more embodiments, the temperature rise can range from a low of about 2° C., 5° C., or 20° C. to a high of about 50° C., 100° C., or 150° C.

The liquid or partially vaporized LNG exiting the first heat transfer zone 30 via line 35 can be introduced to the second heat exchange zone 60 where the LNG can be heated against a heat transfer medium ("second heat transfer medium" or "HTF") via line 45. In one or more embodiments, the temperature rise of the LNG within the second heat exchange zone 60 can range from a low of about 5° C. to a high of 100° C. In one or more embodiments, the temperature rise of the LNG within the second heat exchange zone 60 can range from a low of about 5° C., 15° C., 25° C., or 40° C. to a high of about 50° C., 60° C., 75° C., or 100° C. Within the second heat transfer zone 60, more of the LNG is vaporized to provide additional vapor within line 65. The additional vapor within the second heat exchange zone 60 can be at least 2% by vol.; 5% by vol.; 20% by vol.; 25% by vol.; 35% by vol.; or at least 50% by vol. of the vapor entering in line 35. Accordingly, the LNG via line 65 can be at least 1% vapor, 10% vapor, 25% vapor, 50% vapor, 75% vapor, 90% vapor or at least 99% vapor, the balance being in liquid phase. The temperature of the LNG within line 65 can be about −165° C. to about 0° C.; about −165° C. to about −50° C.; about −165° C. to about −100° C.; or about −165° C. to about −125° C.

All or a portion of the heated LNG via line 65 can be recycled to the first heat transfer zone 30 to exchange heat with the incoming LNG via line 25, or all or a portion of the heated LNG via line 65 can be introduced to the third heat transfer zone 90 and heated to the desired temperature. The LNG within line 65 that is recycle to the first heat transfer zone 30 can enter the first heat transfer zone 30 at a temperature of from about −165° C. to about 0° C.; about −165° C. to about −50° C.; about −165° C. to about −100° C.; or about −165° C. to about −125° C. The recycled LNG can exit the first heat transfer zone 30 via line 70. The LNG via line 70 can then be heated to the desired temperature within the third heat exchange zone 90 against a heat transfer medium ("third heat transfer medium" or "HTF") via line 50.

The heat transfer mediums via line 45 and 50 can be the same or different. In one or more embodiments, the heat transfer mediums can include, but are not limited to methane, ethane, propane, butane, pentane, halogenated hydrocarbons, ammonia, glycol-water mixtures, formate-water mixtures, alcohols (including, but not limited to, methanol, ethanol and/or propanol), mixtures thereof, derivatives thereof and/or combinations thereof. The heat transfer mediums can also be or include steam, superheated steam, and/or condensate.

The heat transfer medium supply temperature to the heat transfer zones 60, 90 can depend upon the fluid selected. For example, water based heat transfer media can be supplied at a temperature well above its freezing point to minimize the likelihood of freezing within the second heat transfer zone 60. Hydrocarbons and other vaporized heat transfer media can be supplied at a temperature where the fluid is completely vaporized when entering the second heat transfer zone to provide additional heating capacity via the latent heat of the medium. In one or more embodiments, the second heat transfer medium can enter the heat transfer zones 60, 90 at a minimum temperature of about −125° C. or greater, about −100° C. or greater, about −50° C. or greater, about −25° C. or greater, about 0° C. or greater, or about 10° C. or greater.

In one or more embodiments, the heat transfer medium can exit the heat transfer zones 60, 90 via lines 75 and 80. In one or more embodiments, the heat transfer medium can exit the heat transfer zones 60, 90 at a minimum temperature of about −125° C. or greater, about −100° C. or greater, about −50° C. or greater, about −25° C. or greater, about 0° C. or greater, or about 10° C. or greater. In one or more embodiments, the heat transfer medium can exit the heat transfer zone 60, 90 at a temperature above 0° C. to minimize the likelihood of ice formation in downstream heaters using either ambient air or water to heat the heat transfer medium, as described in embodiments below with reference to FIG. 2.

In one or more embodiments, the LNG exiting the third heat transfer zone 90 via line 95 can be completely vaporized. In one or more embodiments, the LNG can exit the third heat transfer zone 90 at a temperature of from about −155° C. to about 0° C., about −155° C. to about −50° C., about −155° C. to about −100° C., or about −155° C. to about −125° C. In one or more embodiments, the substantially vaporized LNG exiting the third heat transfer zone via line 95 can be about 99% vapor, about 99.5% vapor, or about 99.9% vapor, the balance being liquid phase.

Figure 2:
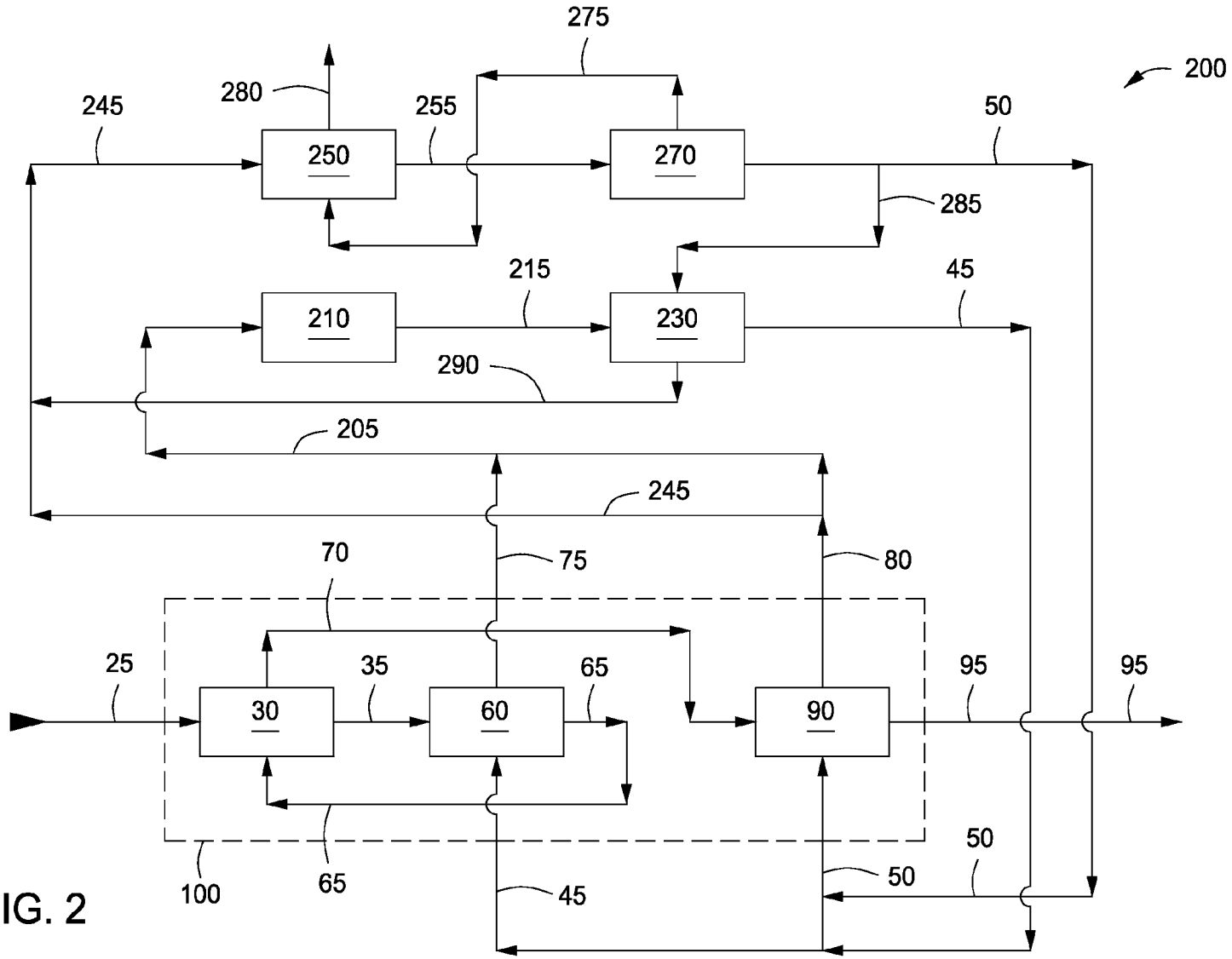
FIG. 2 depicts another illustrative system for vaporizing a cryogenic fluid, according to one or more embodiments described.

FIG. 2 depicts another illustrative system 200 for vaporizing a cryogenic fluid according to one or more embodiments. The system 200 can include the system 100 described above with reference to FIG. 1, and can further include one or more heaters (four are shown 210, 230, 250, 270) for warming or re-heating the heat transfer medium supplied to the heat transfer zones 60, 90.

As mentioned, the same heat transfer medium can be supplied to both the second and third heat transfer zones 60, 90. The heat transfer medium can exit the heat transfer zones 60, 90 via lines 75 and 80. Lines 75 and 80 can discharge into a return header 205 for return to the heater ("first stage heater") 210. The temperature of the heat transfer medium in the return header 205 can be above about −25° C., about −10° C., above −5° C., or about 0° C. In one or more embodiments, the temperature of the heat transfer medium in the return header 205 can be above 0° C. to prevent ice formation within the one or more heaters 210, 230, 250, 270 used to reheat the heat transfer medium.

In one or more embodiments, the heat transfer medium can be directed via line 205 to the one or more first-stage heaters 210 to provide a warmer heat transfer medium via line 215, i.e. the heat transfer medium in line 215 has a temperature greater than the temperature in line 205. The temperature of the heat transfer medium in line 215 can be further increased using the one or more heaters ("second-stage heater") 230 to provide the heat transfer medium at a temperature suitable for return to the system 100 via line 45 and/or 50.

In one or more embodiments, the one or more first-stage heaters 210 can be an ambient air heater including, but not limited to fin-fan, shell-and-tube, and plate and frame type heat exchangers, or any combination thereof. In one or more embodiments, where ambient air heaters (e.g. fin-fan heaters) are used for the one or more first-stage heaters 210, ambient air can provide sufficient heat input to the second heat transfer medium when the ambient air temperature exceeds about 5° C., about 10° C., about 15° C., or about 20° C. However under low ambient conditions, where the ambient air temperature is less than about 20° C., about 15° C., about 10° C., or about 5° C., supplemental heat, supplied by the one or more second-stage heaters 230, can be used to raise the temperature of the second heat transfer medium prior to returning the second heat transfer medium to the cryogenic fluid heater 100.

In one or more embodiments, the one or more second-stage heaters 230 can include, but are not limited to fin-fan, shell-and-tube, plate and frame, spiral wound heat exchangers, or any combination thereof. In one or more embodiments, the one or more second-stage heaters 230 can include one or more fired heaters employing a combustion process to generate thermal energy to warm the second heat transfer medium. In one or more embodiments, any warm fluid (i.e. any fluid with a temperature greater than the temperature of the second heat transfer medium within line 215) can be used to increase the temperature of the second heat transfer medium in the second-stage heater 230. In one or more embodiments, the one or more first-stage heaters 210 and/or second-stage heaters 230 can be configured to collect and direct condensate forming on the heat exchange surfaces within the heaters to a remote location for treatment prior to discharge.

In one or more embodiments, a particular heat transfer medium ("second heat transfer medium" or "second HTF") can be used exclusively within the second heat transfer zone 60 and another particular heat transfer medium ("third heat transfer medium" or "third HTF") can be used exclusively in the third heat transfer zone 90. The third heat transfer medium can exit the third heat transfer zone 90 via line 80 which can discharge into its own return header 245 for return to a first-stage heater 250. In one or more embodiments, process heat supplied via line 275 can be used to warm the third heat transfer medium within the first-stage heater 250. The temperature of the third heat transfer medium in line 245 can be maintained above about −100° C., about −50° C., about −25° C., about −10° C., above −5° C., or about 0° C. In one or more embodiments the temperature of the third heat transfer medium in line 245 can be maintained above 0° C. thereby minimizing the possibility of ice formation on the first-stage heater 250.

In one or more embodiments, the third heat transfer medium can exit the one or more first-stage heaters 250 as a warmer third heat transfer medium via line 255, i.e. the third heat transfer medium in line 255 has a temperature greater than the temperature in line 245. The temperature of the third heat transfer medium in line 255 can be further increased using one or more second-stage heaters 270 to provide the third heat transfer medium at a temperature suitable for return to the cryogenic fluid heater 100 via line 50.

In one or more embodiments, at least a portion of the warm third heat transfer medium in line 50 can be supplied to the second-stage heater 230 via line 285, to warm the second heat transfer medium therein. The third heat transfer medium can exit the second-stage heater 230, via line 290 which can discharge into the return header 245 for return to the first-stage heater 250.

In one or more embodiments, the one or more first-stage heaters 250 can be an ambient air heater including, but not limited to, fin-fan, shell-and-tube, and plate and frame type heat exchangers. In one or more embodiments, the one or more heaters 250 can be a regenerative type heater recovering thermal energy from hot process fluid (not shown). In one or more embodiments, the one or more second-stage heaters 270 can include, but are not limited to, shell-and-tube, plate and frame, spiral wound heat exchangers or any combination thereof. In one or more embodiments, any warm fluid (i.e. any fluid with a temperature greater than the temperature of the tempered third heat transfer medium contained within line 255) can be used to increase the temperature of the third heat transfer medium in the second-stage heater 270. In one or more embodiments, the one or more second-stage heaters 270 can be a direct-fired heater using a combustion process to generate thermal energy warming the third heat transfer medium therein. In one or more embodiments, the one or more first-stage heaters 250 and/or second-stage heaters 270 can be configured to collect and direct condensate forming on the heat exchange surfaces within the heaters to a remote location for treatment prior to discharge.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for vaporizing a fluid, comprising:

heating a fluid to a first temperature sufficient to at least partially vaporize the fluid and produce a partially vaporized fluid at the first temperature;

heating the partially vaporized fluid at the first temperature to a second temperature of about −165° C. to about −50° C. to increase the vapor content of the partially vaporized fluid;

recycling a first portion of the partially vaporized fluid at the second temperature, comprising:

heating the fluid to the first temperature with heat from the first portion of the partially vaporized fluid; and cooling the first portion of the partially vaporized fluid to produce a cooled fluid; and heating a second portion of the partially vaporized fluid at the second temperature and the cooled fluid to a third temperature, which is greater than the second temperature, to produce a substantially vaporized fluid at the third temperature, wherein the first portion of the partially vaporized fluid at the second temperature has the same composition as the partially vaporized fluid at the first temperature and the second portion of the partially vaporized fluid at the second temperature.

2. The method of claim 1, wherein a heat transfer medium is used to heat the partially vaporized fluids to the second and third temperatures.

3. The method of claim 2, wherein the heat transfer medium comprises methane, ethane, propane, butane, pentane, halogenated hydrocarbons, ammonia, glycol-water mixtures, formate-water mixtures, methanol, ethanol, propanol, mixtures thereof, or combinations thereof.

4. The method of claim 1, wherein the fluid comprises liquefied natural gas, liquefied petroleum gas, liquefied oxygen, liquefied nitrogen, liquefied hydrocarbons, mixtures thereof, or combinations thereof.

5. The method of claim 1, wherein the fluid is liquefied natural gas.

6. The method of claim 2, further comprising re-heating the heat transfer medium using one or more ambient air heaters.

7. The method of claim 1, wherein the fluid consists essentially of LNG, the first temperature is about −175° C. to about −50° C., and the third temperature is about −155° C. to about −0° C.

8. The method of claim 1, wherein an interchanger is used to heat the fluid to the first temperature with the first portion of the partially vaporized fluid and to cool the first portion of the partially vaporized fluid to produce the cooled fluid.

9. The method of claim 8, wherein heating the fluid to the first temperature is within a first heat exchange zone, heating the partially vaporized fluid to the second temperature is within a second heat exchange zone, and heating the second portion of the partially vaporized fluid at the second temperature and the cooled fluid to a third temperature is within a third heat exchange zone.

10. A method for vaporizing a fluid, comprising:

heating a fluid at a pressure of about 100 kPa to about 1,000 kPa within a first heat exchange zone to a first temperature to produce a first heated fluid;

heating the first heated fluid within a second heat exchange zone to a second temperature of about −165° C. to about −50° C. to produce a second heated fluid;

recycling a first portion of the second heated fluid from the second heat exchange zone at the second temperature through an interchanger comprising the first heat exchange zone to heat the fluid to the first temperature with heat from the first portion of the second heated fluid and produce a cooled fluid from the first portion of the second heated fluid; and heating a second portion of the second heated fluid and the cooled fluid from the interchanger within a third heat exchange zone to a third temperature, which is greater than the second temperature and is about −155° C. to about 0° C., to produce a substantially vaporized fluid, wherein the first portion of the second heated fluid used to heat the fluid to the first temperature has the same composition as the first heated fluid that is discharged from the first heat exchange zone at the first temperature and the second portion of the second heated fluid that is discharged from the second heat exchange zone at the second temperature.

11. The method of claim 10, wherein each heat exchange zone is a shell and tube heat exchanger.

12. The method of claim 10, wherein a heat transfer medium is used to heat the first heated fluid to the second temperature or the second heated fluid to the third temperature.

13. The method of claim 12, wherein the heat transfer medium comprises methane, ethane, propane, butane, pentane, halogenated hydrocarbons, ammonia, glycol-water mixtures, formate-water mixtures, methanol, ethanol, propanol, mixtures thereof, or combinations thereof.

14. The method of claim 13, further comprising re-heating the heat transfer medium using one or more ambient air heaters.

15. The method of claim 10, wherein the fluid comprises liquefied natural gas, liquefied petroleum gas, liquefied oxygen, liquefied nitrogen, liquefied hydrocarbons, mixtures thereof, or combinations thereof.

16. The method of claim 10, wherein the fluid consists essentially of LNG, the first temperature is about −175° C. to about −50° C., and the third temperature is about −155° C. to about 0° C.

17. A method for vaporizing a fluid, comprising:

heating a fluid at a pressure of about 100 kPa to about 1,000 kPa within a first heat exchange zone to a first temperature to produce a first heated fluid;

heating the first heated fluid within a second heat exchange zone to a second temperature of about −165° C. to about −50° C. to produce a second heated fluid, wherein a first portion of the second heated fluid at the second temperature is used as a first heat transfer medium to heat the fluid within the first heat exchange zone to the first temperature;

heating a second portion of the second heated fluid from the second heat exchange zone and the first heat transfer medium from the first heat exchange zone within a third heat exchange zone to a third temperature, which is greater than the second temperature, to produce a substantially vaporized fluid at the third temperature, wherein a second heat transfer medium is used to provide heat to the second and third heat exchange zones; and heating the second heat transfer medium using one or more ambient air exchangers, wherein the first portion of the second heated fluid has the same composition as the first heated fluid that is discharged from the first heat exchange zone at the first temperature and the second portion of the second heated fluid that is discharged from the second heat exchange zone at the second temperature.

18. The method of claim 17, wherein the first heat exchange zone is an interchanger adapted to heat the fluid to the first temperature with heat from the first heat transfer fluid medium.

19. The method of claim 17, wherein the second heat transfer medium comprises methane, ethane, propane, butane, pentane, halogenated hydrocarbons, ammonia, glycol-water mixtures, formate-water mixtures, methanol, ethanol, propanol, mixtures thereof, or combinations thereof.

20. The method of claim 17, wherein the fluid consists essentially of LNG, the first temperature is about −175° C. to about −50° C., and the third temperature is about −155° C. to about 0° C.

* * * * *